US010362831B2

(12) United States Patent
Bigolin

(10) Patent No.: US 10,362,831 B2
(45) Date of Patent: Jul. 30, 2019

(54) CYCLING SHOE

(71) Applicant: Selle Royal S.p.A., Pozzoleone (Vicenza) (IT)

(72) Inventor: Barbara Bigolin, Asolo (IT)

(73) Assignee: SELLE ROYAL S.P.A., Pozzoleone (Vicenza) (IT)

( * ) Notice: Subject to any disclaimer, the term of this patent is extended or adjusted under 35 U.S.C. 154(b) by 169 days.

(21) Appl. No.: 15/107,739

(22) PCT Filed: Dec. 23, 2014

(86) PCT No.: PCT/IB2014/067273
§ 371 (c)(1),
(2) Date: Jun. 23, 2016

(87) PCT Pub. No.: WO2015/097666
PCT Pub. Date: Jul. 2, 2015

(65) Prior Publication Data

US 2016/0331068 A1 Nov. 17, 2016

(30) Foreign Application Priority Data

Dec. 23, 2013 (IT) ..... VR2013A0293

(51) Int. Cl.

| | |
|---|---|
| ***A43B 5/14*** | (2006.01) |
| ***A43B 7/08*** | (2006.01) |
| ***A43B 3/00*** | (2006.01) |
| ***A43B 23/02*** | (2006.01) |

(52) U.S. Cl.
CPC ..... *A43B 5/14* (2013.01); *A43B 3/0036* (2013.01); *A43B 7/081* (2013.01); *A43B 7/085* (2013.01); *A43B 7/087* (2013.01); *A43B 7/088* (2013.01); *A43B 23/0245* (2013.01)

(58) Field of Classification Search
CPC ..... A43B 1/0009; A43B 5/14; A43B 5/145; A43B 7/085; A43B 7/087; A43B 21/38
USPC ..... 36/105, 131
See application file for complete search history.

(56) References Cited

U.S. PATENT DOCUMENTS

| | | | | |
|---|---|---|---|---|
| 4,078,321 | A * | 3/1978 | Famolare, Jr. | A43B 5/00 36/3 B |
| 4,640,027 | A * | 2/1987 | Berlese | A43B 7/08 36/131 |
| 4,679,335 | A * | 7/1987 | Berlese | A43B 7/08 36/131 |
| 4,825,565 | A * | 5/1989 | Bigolin | A43B 5/14 36/131 |
| 7,913,421 | B2 * | 3/2011 | Malenotti | A43B 5/145 36/131 |
| 8,763,279 | B2 * | 7/2014 | Torrance | A43B 5/14 36/131 |
| 2004/0020075 | A1 | 2/2004 | Garneau | |

(Continued)

FOREIGN PATENT DOCUMENTS

| | | |
|---|---|---|
| EP | 1857000 | 11/2007 |
| ES | 1078583 | 2/2013 |

(Continued)

*Primary Examiner* — Sharon M Prange
(74) *Attorney, Agent, or Firm* — Tutunjian & Bitetto, P.C.

(57) ABSTRACT

A cycling shoe, including a sole as well as an upper that rises from the sole; the surface of the upper includes a plurality of recesses adapted to reduce the form drag of the upper hit by the air during the execution of the pedalling motion.

15 Claims, 12 Drawing Sheets

(56) References Cited

U.S. PATENT DOCUMENTS

| | | | | |
|---|---|---|---|---|
| 2006/0010716 | A1 | 1/2006 | Kerns et al. | |
| 2009/0293318 | A1* | 12/2009 | Garneau | A43B 5/14 36/131 |
| 2010/0301632 | A1 | 12/2010 | Bryne | |
| 2011/0056095 | A1* | 3/2011 | Torrance | A43B 3/24 36/132 |
| 2011/0126431 | A1* | 6/2011 | Mazzarolo | A43B 5/145 36/3 A |
| 2012/0261945 | A1 | 10/2012 | Litchfield | |
| 2014/0007461 | A1* | 1/2014 | Carbo, Jr. | A43B 13/02 36/103 |

FOREIGN PATENT DOCUMENTS

| | | |
|---|---|---|
| ES | 2428214 | 11/2013 |
| FR | 2734994 | 12/1996 |
| WO | WO2004089741 | 10/2004 |
| WO | WO2011159301 | 12/2011 |

* cited by examiner

TABLE 1

| | EXTRA SOFT | SOFT | MEDIUM SOFT | MEDIUM HARD | HARD | EXTRA HARD |
|---|---|---|---|---|---|---|
| SHORE 00 | 20 30 35 40 50 | 55 60 70 | 80 | 90 | 95 98 | |
| SHORE A | | 10 20 30 | 40 50 | 60 | 70 80 | 90 95 100 |
| SHORE D | | | | | 22 25 35 | 45 55 65 75 |

FIG. 20

CYCLING SHOE

TECHNICAL FIELD OF THE INVENTION

The present invention regards a cycling shoe.

STATE OF THE PRIOR ART

It is known that in the cycling industry, particularly at professional and racing level, both the cyclists bicycle and garments are subject of continuous studies and research to reduce the weight and improve the aerodynamic characteristics.

In particular, as regards cycling shoes, up to date there have been proposed various shoes in which the main objectives have been reducing weight on the one hand and increasing the cyclist's comfort on the other.

The same attention has not been dedicated to the aerodynamic behaviour of the human-bicycle system, with particular reference to the area of the central movement, where there are normally generated major turbulences during the execution of the rotational motion of the pedalling.

Thus, there arises the need to have a cycling shoe which, besides the normal low weight and high comfort needs of the user, can also provide optimal performance from an aerodynamic point of view when pedalling.

SUMMARY OF THE INVENTION

The technical task of the present invention is to improve the prior art.

Within this task, an object of the present invention is to provide a cycling shoe capable of allowing improving the aerodynamic performance of the human-bicycle system in particular at the central movement area.

This task and these objects are attained by a cycling shoe according to the present principles.

According to an aspect of the present invention, the surface of the upper of the shoe comprises a plurality of recesses, particularly distributed in the area of the front part of the upper, suitable to reduce the form drag thereof.

According to another aspect of the present invention, the heel of the upper comprises respective channels for conveying the air that hits the shoe, which contribute to the reduction of the form drag of the shoe.

According to a further aspect of the present invention, the heel of the sole of the shoe comprises a channel for conveying the air, which also contributes to the reduction of the form drag of the shoe.

The present specification refers to preferred and advantageous embodiments of the invention.

BRIEF DESCRIPTION OF THE DRAWINGS

Other characteristics and advantages of the invention shall be more apparent from the description of embodiments of a shoe, illustrated by way of example in the attached drawings wherein:

FIG. 20 depicts an exemplary Shore hardness scale shown as Table 1.

In the attached drawings equal parts or components are distinguished by the same reference numbers.

DETAILED DESCRIPTION

Figure 1:
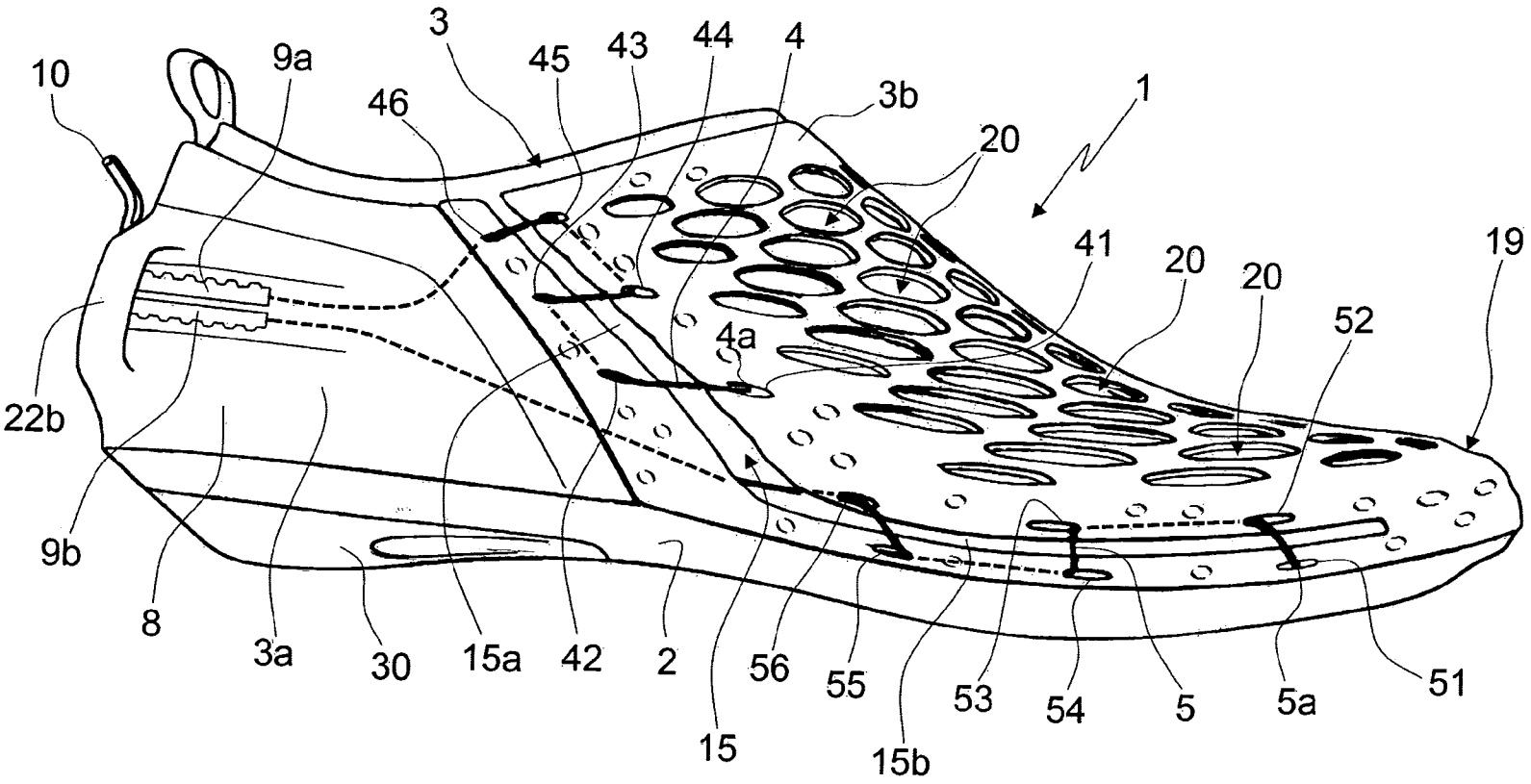
FIG. 1 is a lateral view of the shoe according to the present invention.
Figure 2:
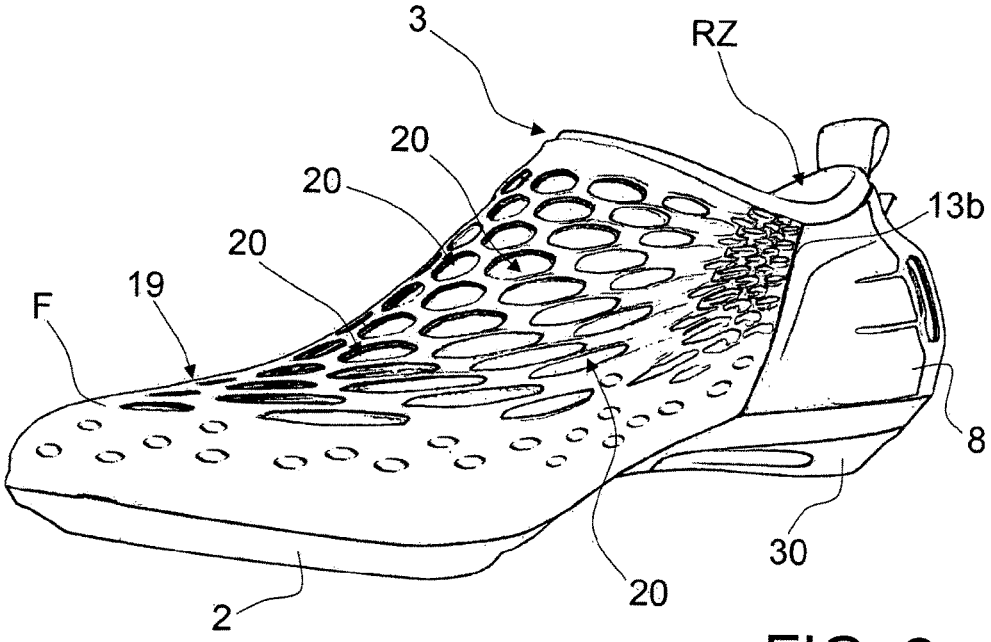
FIG. 2 is a perspective view of the shoe.
Figure 3:
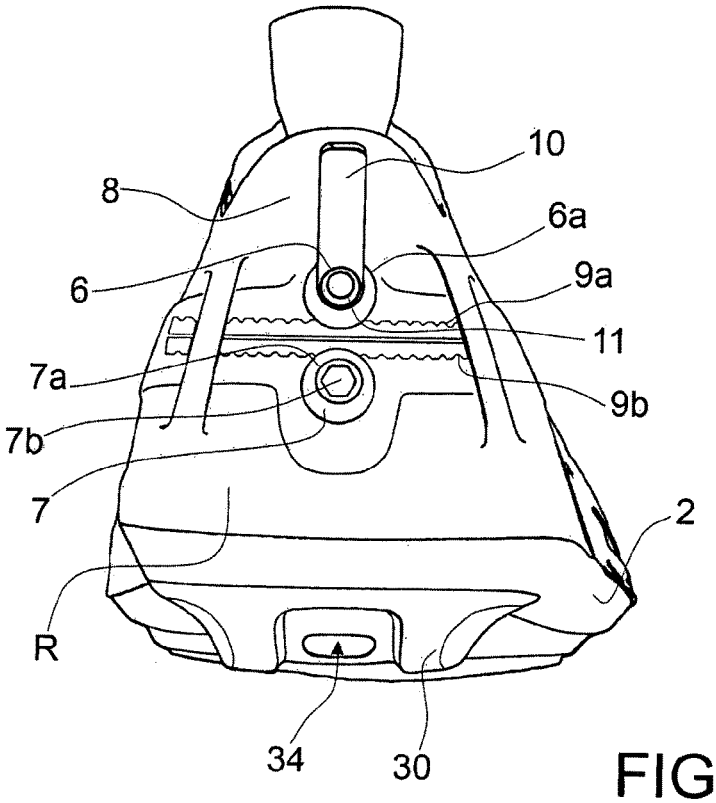
FIG. 3 is a rear view of the shoe.

With reference to the attached figures a cycling shoe according to the present invention is indicated in its entirety with 1.

The shoe 1 comprises a sole 2.

The shoe 1 also comprises an upper 3.

The upper 3 rises from the sole 2.

As better clarified hereinafter, the upper 3 comprises two or more portions 3*a*, 3*b* at least partly mutually displaceable (i.e. with respect to the other).

In particular the upper 3 comprises a fixed portion 3*a* and a mobile portion 3*b* at least partly displaceable with respect to the fixed portion 3*a*, so as to adjust the housing width or volume RZ for a foot in the shoe 1.

As regards the mutually displaceable portions, they are displaceable one with respect to the other and they can be both mobile, or one fixed and the other mobile with respect to the first.

In addition, the upper 3 also comprises a core 3*c*.

The core 3*c* delimits the housing volume RZ. Around the core there are mounted the mutually displaceable portions 3*a*, 3*b*.

More in detail, in an embodiment of the invention the mutually displaceable portions 3*a*, 3*b* are constituted by mask components mounted around, and covering or wrapping the core 3*c*; in such case, mutually moving the mutually displaceable portions 3*a*, 3*b* allows modifying the shape or configuration of the core 3*c* (ad for example it can be narrowed) thus varying the housing volume RZ.

Regarding this, the core 3*c* may be obtained using soft material, for example rubber or another similar material.

The material the core 3*c* is made of may have, for example, a Shore hardness 00 approximately comprised between 50 and 70. It is thus classified as soft.

Actually, the materials are usually classified as follows (see table 1 shown in FIG. 20):

Extra soft: Shore 00 from 20 to 50 (e.g. chewing gum and racquetball balls),

Soft: Shore 00 from 50 to 70 (e.g. rubber band),

Medium soft: Shore 00 from 70 to 30 (e.g. pencil eraser),

Medium hard: Shore 00 from 80 to 95 (e.g. tyre),

Hard: Shore 00 higher than 95 or Shore D from 22 to 35 (e.g. the heel of a shoe), Extra hard: Shore D from 35 to over 75 (e.g. wheels of shopping trolleys or rigid material caps).

The mutually displaceable portions 3*a*, 3*b* can be made of material more rigid than the core 3*c*, possibly made of plastic or composite material.

The mutually displaceable portions 3*a*, 3*b* shall be described more in detail hereinafter, according to a non-limiting example.

The shoe 1 comprises, according to an aspect of the present invention, means 4, 5 for tightening/releasing the mutually displaceable portions 3*a*, 3*b*.

According to an embodiment of the invention, the tightening/release means 4,5 can, for example, comprise one or a plurality of cable elements 4, 5, possibly made of steel, two according to the illustrated example.

The cable elements 4,5 comprise respective first ends 4*a*, 5*a* fixed to one of the mutually displaceable portions 3*b*, preferably to the mobile portion, and respective second ends 4*b*, 5*b* which can be adjustably engaged with the other of the mutually displaceable portions 3*a*, preferably the fixed portion.

According to another aspect of the present invention, the shoe 1 comprises means 6, 7 for controlling the tightening/release means 4, 5.

The control means 6,7 can be actuated or arranged at the rear part R or, preferably, at the heel 8 of the shoe 1, i.e. the part intended to wrap the heel or rear part of the user's foot.

Preferably, the control means 6,7 include at least one component 6 for the longitudinal or front part F—rear part R approach/removal of the mutually displaceable portions 3*a*, 3*b*.

In addition, the control means 6,7 comprise a component 7 for the lifting/lowering of one of the mutually displaceable portions 3*a*, 3*b* with respect to each other.

The longitudinal approach/removal component 6 is intended to control the tightening/release means 4 to tighten the mutually displaceable portions 3*a*, 3*b* in the front part F-rear part R direction, so as to engage from the front part F towards the rear part R or vice versa the core 3*c*, if provided.

Preferably, the approach/removal component 6 is intended to displace the mobile portion 3*b* or a part thereof towards the rear part R and towards the fixed portion 3*a* so as to fasten the core 3*c* or towards the front part F or far from the fixed portion 3*a* so as to allow a widening of the core 3*c*.

The lifting component 7 is instead intended to control the tightening/release means 5 so as to mutually vertically fasten the two portions or parts 3*a*, 3*b* thereof and, if provided the core 3*c*, to tighten the latter through the portions 3*a*, 3*b* from the bottom towards the top or vice versa.

Preferably, the lifting component 7 is intended to displace the mobile portion 3*b* or part thereof towards the bottom and towards the fixed portion 3*a*, so as to tighten the core 3*c*, for example the tip and a front part thereof, or towards the top or far from the fixed portion 3*a*, so as to release the core 3*c*, for example the tip and a front portion of the core 3*c*.

Even more preferably, the control means comprise at least one pinion component 6, 7 mounted on one of the mutually displaceable portions, possibly on a fixed portion 3*a*, as well as a rack element 9*a*, 9*b* constrained on one side to a respective cable element 4, 5 fixed to the other of the mutually displaceable portions 3*b*, and on the other side engageable by means of one or a respective pinion component 6, 7.

A first end of a rack element 9*a*, 9*b* can be fixed to a respective cable element 4, 5 for example via gluing, welding or by means of insertion and locking of a cable element 4, 5 in a slot formed in such first end.

The other or second end of the rack element 9*a*, 9*b* can be free, while an intermediate portion of the rack element is slidably mounted in meshing engagement with a respective pinion component 6, 7.

The pinion component 6, 7 can be rotatably mounted around a substantially horizontal axis or in the front part F—rear part R direction, e.g. transverse to the upper and from the outside towards the inside thereof, while the rack element(s) 9*a*, 9*b* can have preferably substantially horizontal position and be extended in a direction around the housing volume RZ.

The upper 3 of the shoe 1 comprises a heel 8.

A pinion component 6, 7 can be rotatably mounted in the heel 8, while a respective rack 9*a*, 9*b* is slidably guided in meshing engagement with a respective pinion element 6, 7.

For such purpose, the fixed portion 3*a* can have, overall or in part, a closed shell-like body delimiting a suitably-shaped zone for the sliding and guiding of the rack element(s) 9*a*, 9*b*, in which also the pinion element(s) 6, 7 projects(s).

Possibly, the shell-like body of the fixed portion 3*a* can comprise projecting parts or parts in relief delimiting the sliding and guiding zone for the rack element(s) 9*a*, 9*b*.

Advantageously, the cable element(s) 4, 5 engage(s) the movable portion 3*b* at a plurality of zones, such that by controlling the operation of the control means 6, 7, an overall and non-localised tightening or release of the two mutually displaceable portions 3*a*, 3*b* is determined.

For such purpose, a cable element 4 can be constrained to the movable portion 3*b* in an intermediate or lower zone thereof and returned one or more times (three according to the illustrated embodiment) between movable portion 3*b* and fixed portion 3*a* or between separated sections 3*b*1 and 3*b*2 of one of such portions 3*b*.

This can for example be obtained by means of the passage or subsequent return of the cable element 4 in eyelets 41, 42, 43, 44, 45, 46 formed in such portions, 3*a*, 3*b* or in sections 3*b*1, 3*b*2 of a portion 3*b*.

The eyelets 41, 42, 43, 44, 45, 46 are arranged at different levels of the upper and of one or both portions 3*a*, 3*b* until the cable element 4 reaches a rear edge 13*a* of the movable portion 3*b*, thus a front edge 12*a* of the fixed portion 3*a* and from here it is conveyed to the control means, hence, if provided, it reaches the respective rack element 9*a*.

If desired, in the fixed portion 3*a* and/or in the movable portion 3*b*, insertion grooves can be provided for the guiding and sliding of the cable element 4.

The cable element 4 can constitute a component 6 for longitudinal or front F-back R approach-removal of the control means.

A cable element 5 can also be constrained to the movable portion 3*b* in a front zone thereof and be returned one or more times (three according to the illustrated embodiment) between movable portion 3*b* and fixed portion 3*a* or between sections 3*b*1, 3*b*2 of one of such portions 3*b* by means of passage of the cable element 5 in respective eyelets 51, 52, 53, 54, 55, 56 arranged at zones with different longitudinal or front F—back R position of the upper, until a rear edge 13*a* of the movable portion 3*b* is reached and from here it is conveyed towards a front edge 12*a* of the fixed portion 3*a* and then to the control means, hence, if provided, to the respective rack element 9*b*.

Also in such case, if desired in the fixed portion 3*a* and/or in the movable portion 3*b*, grooves can be provided for the insertion and sliding of the cable element 5. The cable element 5 can represent a component 7 for the mutual lifting-lowering of the mutually displaceable portions 3*a*, 3*b*.

According to the embodiment illustrated in the Figures, two pinion components 6, 7 are provided for, each intended to control the sliding of a respective rack element 9*a*, 9*b*, each rack element 9*a*, 9*b* being fixed to a respective cable element 4, 5. In such case, the two rack elements 9*a*, 9*b* can be substantially horizontal.

According to such embodiment, the first cable element 4 is upper during use and is extended starting from the respective rack element 9*a* to a front edge 12*a*, if desired at the top of such edge, of the fixed portion 3*a* and from here it is extended beyond the fixed portion 3*a* until it engages the movable portion 3, if desired at the top thereof.

One or more pinion components 6, 7 can also have an outer head 6*a*, 7*a* or a head projecting outside the sole 2, from the outer head 7*a* there possibly extending a toothed wheel or the like (not illustrated in the drawings) or a stem on which there is mounted a toothed wheel.

Advantageously, the control means also comprise a lever 10 for controlling the rotation of the pinion component 6, which can be elastically loaded.

Preferably, the control lever 10 is elastically loaded, but it is disengaged from the respective pinion component 6 after having controlled the rotation thereof, such that—after a respective angular movement or actuation thereof with consequent rotation of the pinion component 6—it returns in rest position, with substantially vertical position and free grip portion that is extended upward. Thus, the control lever 10 can be a kind of "ratchet" or "ratchet key" with position return spring and allows a snap adjustment with fixed pitch of the pinion component 6. Due to such expedient, the user always knows the position of the lever 10 (e.g. substantially vertical) and is able to reach it and control it appropriately during the execution of a sport, e.g. during pedalling.

Advantageously, the control lever 10 is substantially curved, e.g. helical, so as to provide an easy grip surface for the user, e.g. for a thumb thereof.

Alternatively, in the outer head 7*a* of a pinion component 7 there may be delimited a seat 7*b* for the engagement of an actuation tool, for example a screwdriver or Allen wrench.

Figure 6:
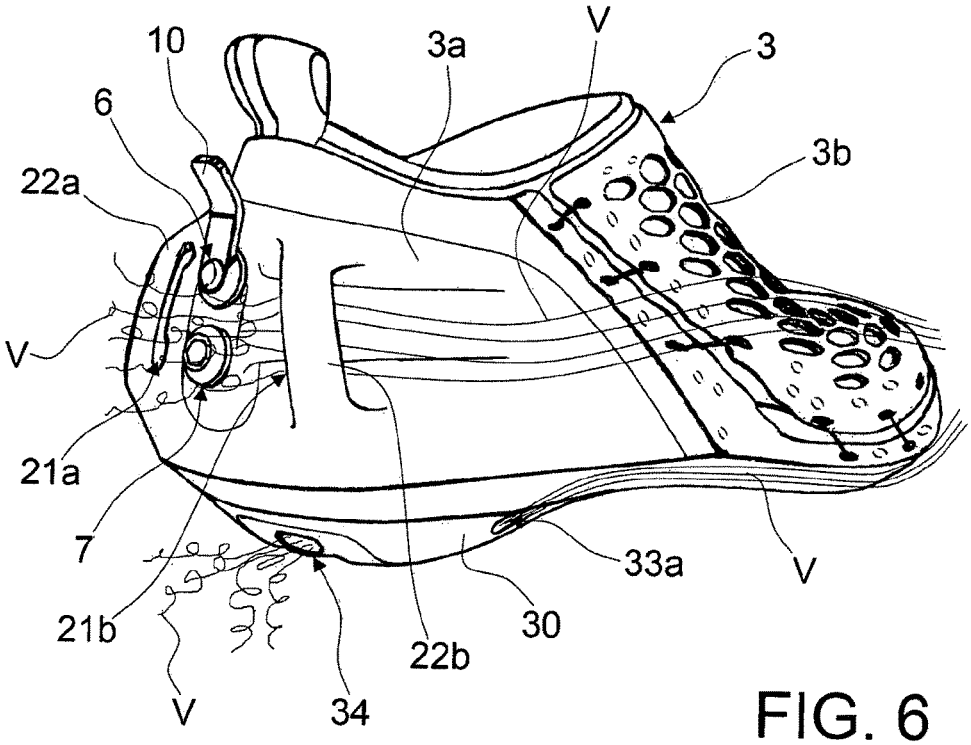
FIG. 6 is a rear perspective view of the shoe schematically illustrating the aerodynamic behaviour thereof when pedalling.

In addition, a pinion component 6 can be displaceable between a rest position (in which the mutually displaceable portions 3*a*, 3*b* are arranged as in FIG. 6 and hence are loosely constrained to each other so as to not reduce the housing size or volume RZ) and a work position (in which the mutually displaceable portions 3*a*, 3*b* are arranged as in FIG. 1, i.e. rigidly constrained in a manner so as to reduce—or adapt to the specific size of the foot of the user—the housing size or volume RZ); in such working position, the pinion 6 is rotated with respect to the rest position, and a button 11 is provided for releasing the pinion 6 intended to take the latter back into rest position.

With regard to the mutually displaceable portions 3*a*, 3*b*, illustrated by way of example in FIG. 1, these can comprise a substantially front tongue part 3*b* as well as a lateral-rear part 3*a*, possibly U-shaped, e.g. with section increasing downward, which can be constrained to each other.

The tongue part 3*b* can have two rear edges 13*a*, 13*b*, one 13*b* on one side or inner side of the shoe and the other 13*a* on the other side or outer side of the shoe, fixed to the lateral-rear part 3*a* or better yet to respective front edges 12*a*, 12*b* (one on one side and the other on the other side of the fixed portion 3*a*) as well as a lower edge 14 fixed to the sole 2. In the tongue part 3*b*, preferably on the outer side of the shoe, i.e. the side directed away during use and not towards the other shoe worn by the user, a groove 15 can be formed so as to delimit two inner edges 16, 17 therein, each belonging to the two sections 3*b*1, 3*b*2, while the tightening-release means 4, 5 for the mutually displaceable portions are intended to tighten-release the inner edges 16, 17 of the tongue part 3*b*, and consequently to tighten-release one section 3*b*2 of the movable portion 3*b* with respect to the other section 3*b*1 and thus with respect to the fixed part 3*a*.

The groove 15 can be extended from the free upper edge 18 of the tongue portion 3*b* up to the tip thereof. More particularly, the groove 15 can have a first section 15*a* that is extended from the upper edge 18 and with slightly oblique progression or with lower end in a more advanced position or proximal to the front F with respect to the upper end, and thus a second section 15*b* substantially horizontal or parallel to the sole 2.

In such case, the cable element 4 can be returned between inner edges 16, 17 of the movable portion 3*b* at the first section 15*a*, while the cable element 5 can be returned between inner edges 16, 17 of the movable portion 3*b* at the second section 15*b*.

Figure 4:
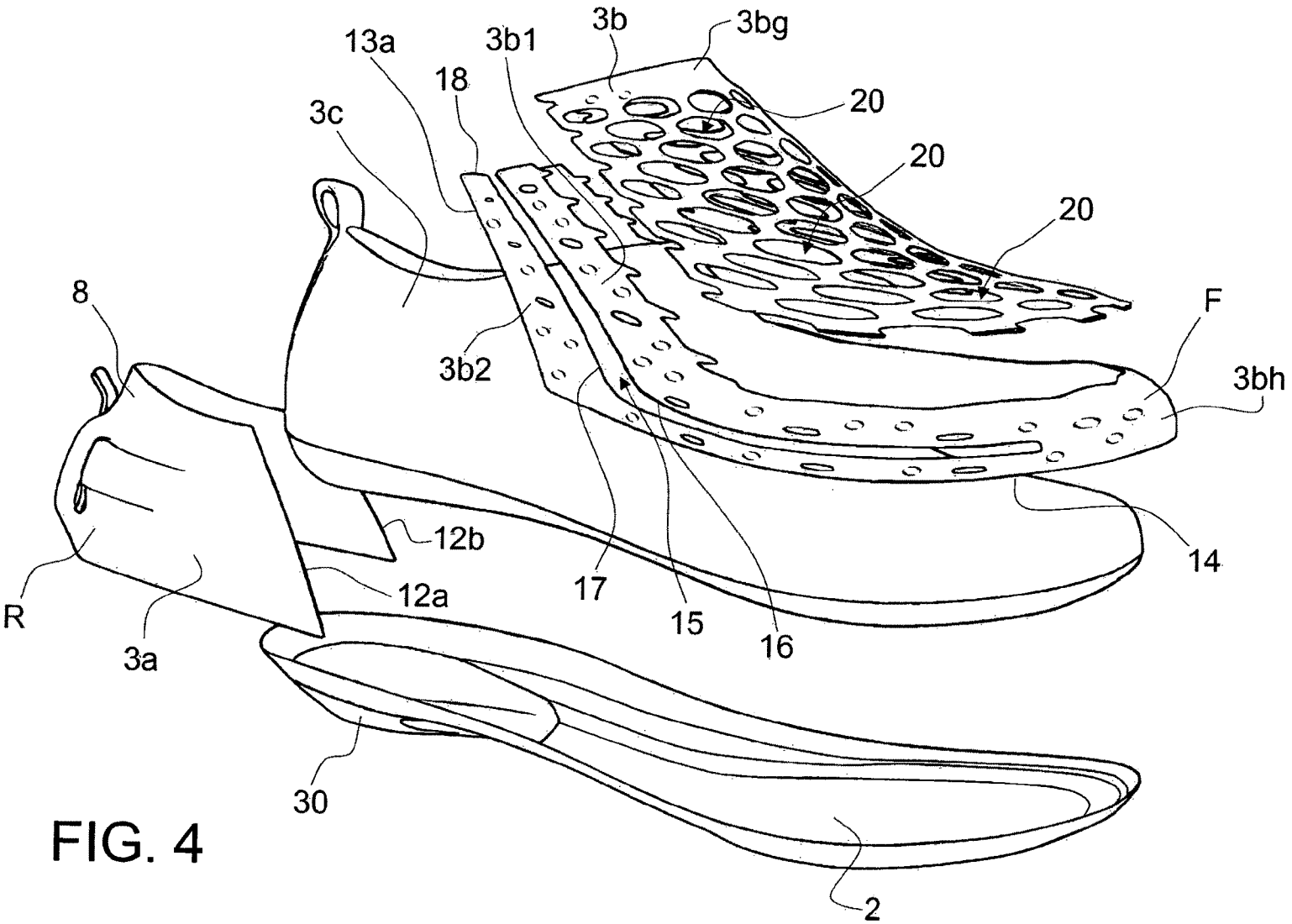
FIG. 4 is an exploded perspective view of the shoe.

FIG. 4 shows an exploded version of the shoe 1 according to the present invention, in which the single components can be observed.

In addition, in the version illustrated in FIG. 4, the movable portion 3*b* can be provided in two separate portions separate 3*bg*, 3*bh*. Such separate portions 3*bg*, 3*bh* can be fixed to each other through co-moulding, coupling, welding or any other means.

The portion 3*bg* is at the front part and it substantially covers the instep of the foot of the user.

The portion 3*bh* is peripheral and it comprises the groove 15. Such portion 3*bh* serves for absorbing the impact for the shoe.

The portions 3*bg*, 3*bh* when assembled, constitute the movable portion 3*b*.

The tongue part 3*b* or the portions thereof 3*bg*, 3*bh* may for example be obtained in more layers or components each made of material having different hardness with respect to the other.

For example, the front part of the tongue 3*b* or the portion 3*bg* can be made of soft material, having a Shore hardness 00 from 50 to 70; the peripheral part of the tongue 3*b* or the portion 3*bh* may be made of medium hardness material, having a Shore hardness 00 from 70 to 80.

The fixed portion 3*a* may for example be made of several layers or components each made of a material having hardness different from the other.

For example, the fixed portion 3*a* or the closed body shell thereof can be made of a medium soft material, having a Shore hardness 00 from 70 to 80; the suitably shaped sliding and guiding area of the rack element(s) 9*a*, 9*b*, in which the pinion element(s) 6, 7 project(s) or the projecting parts or parts in relief delimiting the sliding and guide area of the rack element(s) 9*a*, 9*b* can be made of hard material, having a Shore hardness 00 greater than 95 or Shore D from 22 to 35.

In particular, it should be observed that the shoe 1 is entirely assembled without stitches, which, as known, constitute a pressure element on the user's foot and even critical areas as regards the resistance of the upper 3.

The heel 8 serves as an undercut and it confers a particular stability to the rear area of the foot during pedalling.

According to an aspect of the present invention, the surface 19 of the upper 3 of the shoe 1 comprises a plurality of recesses 20.

As clearly observable hereinafter, the recesses 20 have the function of reducing the aerodynamic resistance of the upper 3 of the shoe 1 impacted by the air during the execution of the pedal motion in the advancement of the bicycle.

In particular, the recesses 20 determine the formation—on the surface 19 of the upper 3 impacted by the air during the execution of the pedalling motion—of a turbulent limit layer which detaches from the surface 19 more later than it would occur in case of a laminar limit layer.

Thus, the motion of the shoe 1 generates a lower form drag with respect to the one that would be generated in case of a laminar limit layer.

This allows reducing the component of the aerodynamic resistance constituted by the drag.

In the embodiment represented in the figures, the recesses 20 are particularly distributed in the area of the front part F of the upper 3.

More in detail, the recesses 20 are distributed on the movable portion 3*b* of the upper 3.

In other embodiments of the shoe 1, the recesses 20 could also be distributed on the fixed portion 3*a* of the upper 3.

In the same embodiment, some of the recesses 20 provided in the movable portion 3*b* of the upper 3 are constituted by through openings, i.e. by some kind of eyelets or windows.

Besides generally lightening the upper 3 and making it more flexible, this characteristic also facilitates the transpiration of the cyclist's foot.

In other embodiments of the invention, all recesses 20 may not be of the through type.

The recesses 20 are for example oval or substantially polygonal; they could be of any other suitable shape, without limitations.

In particular, in an embodiment of the invention of particular practical interest, the recesses 20 have oval or substantially polygonal shape, stretched substantially along the longitudinal axis of the shoe, that is along a substantially anterior-posterior direction.

In the area of the front part F of the upper 3, which is particularly important in the context of the aerodynamic behaviour of the shoe 1, the recesses 20 are made with dimensions greater than those foreseen in the other areas of the upper 3.

These particular structures and dimensions of the recesses 20, and their particular orientation substantially along the longitudinal axis of the shoe 1, have experimentally proved to be particularly effective in achieving the desired turbulent limit layer on the surfaces of the upper 3, which, as stated, allows reducing the form drag of the shoe 1.

According to another aspect of the invention, the heel 8 of the shoe 1 comprises at least one channel 21*a*,21*b*, achieved in its thickness, suitable for channeling the air that hits the upper 3 of the shoe 1 when pedalling, thus further reducing the aerodynamic resistance thereof.

More in detail, the heel 8 comprises a first channel 21*a* and a second channel 21*b*, achieved in its thickness, suitable for channeling the air that hits the upper 3.

The first channel 21*a* and the second channel 21*b* are arranged, respectively, on the outer side and on the inner side of the heel 8.

The channels 21*a* and 21*b* are defined for example by respective bridges 22*a*, 22*b* shaped by the heel 8 itself and substantially vertically arranged with respect to the support surface of the sole 2 of the shoe 1.

The section of the channels 21*a*, 21*b* is thus substantially narrow and vertically elongated, still with reference to the support surface of the sole 2.

The section of the channels 21*a*, 21*b* can vary from one end to the other thereof, in a manner so as to obtain the desired air flow conditions: for example, converging sections can give rise to accelerations of the air during its travel along the channels 21*a*, 21*b*, with advantageous effects in conveying the air towards the zone of the heel 8.

In cases where the rack elements 9*a*,9*b* are not mounted slidably in an area delimited by the closed shell body of the fixed portion 3*a*, the rack elements 9*a*,9*b* of the tightening/release means 4,5 may be slidably mounted in the channels 21*a*,21*b*. This solution allows optimising the use of the surface available in the heel 8, and suitably protecting the rack elements 9*a*,9*b*.

In other embodiments, the rack elements 9*a*,9*b* could be arranged in other areas of the surface of the heel 8, depending on the different application needs.

The bridges 22*a*, 22*b* have also the important function of protecting the control means 6, 7—in particular the zone of the heads 6*a*-7*a*—from possible impact that could damage them or accidentally modify the position set by the user.

The shoe 1 also comprises a heelpiece 30.

The heelpiece 30 is integral to the sole 2 of the shoe.

The heelpiece 30 may for example be made of polymeric material, or composite material, or any other suitable material, depending on the specific needs.

Thus, the material of the heelpiece 30 is preferably different from that with which the sole 2 is made; however, in some embodiments of the invention, the heelpiece 30 and the sole 2 could also be made of the same material.

The heelpiece 30 has a shape and thickness such to be connected with the lower face 2*a* of the sole 2 of the shoe.

In other words, the heelpiece 30 does not project with respect to the lower face 2*a* of the sole 2 like in other types of shoes, so as to define a continuous surface alongside the lower face 2*a* of the sole 2.

This contributes to reducing the overall aerodynamic resistance of the shoe 1. According to another aspect of the present invention, the heelpiece 30 comprises a respective channeling 31, which conveys the air through a preset path, with the aim of reducing the overall aerodynamic resistance of the shoe 1.

The channeling 31 for example comprises a first branch 32 and a second branch 33.

The first branch 32 and the second branch 33 of the channeling 31 are respectively open at a first opening 32*a* and a second opening 33*a* provided for on the sides of the heelpiece 30, i.e. respectively on the outer side and on the inner side of the heelpiece 30.

Figure 7:
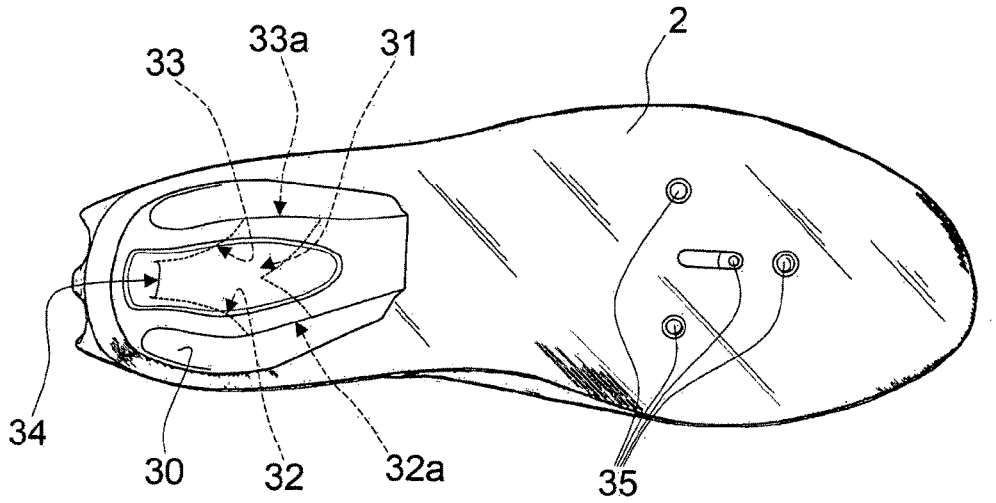
FIG. 7 is a bottom view of the shoe.

The first branch 32 and the second branch 33 communicate with a single rear discharge 34 of the heelpiece 30, as schematically illustrated in FIG. 7.

It is however clarified that the channeling 31 of the heelpiece 30 may be of any other shape suitable to guarantee an efficient conveying of the air towards the rear area of the heelpiece 30.

The sections of the first branch 32 and of the second branch 33 can be constant or variable from the first, second opening 32*a*,33*a* towards the rear discharge 34.

The development of the sections of the first branch 32 and the second branch 33 may evidently affect the aerodynamic behaviour of the shoe 1 in the area of the heelpiece 30: for example, convergent sections may lead to air accelerations in the path thereof along the channel 31, with advantageous effects in the conveyance thereof towards the area of the heel 8.

Figure 5:
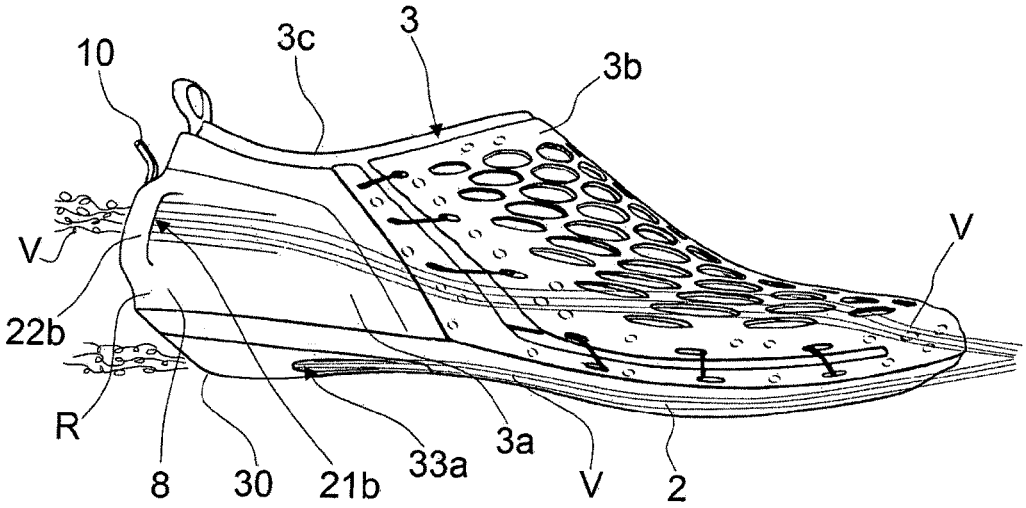
FIG. 5 is a lateral view of the shoe schematically illustrating the aerodynamic behaviour thereof when pedalling.

FIGS. 5 and 6 schematically illustrate—respectively laterally and at the rear part—the flow of the air that hits the upper 3 of the shoe 1 during the execution of the pedalling motion.

As observable in the schematisation, the air hits the front part F of the upper 3, and due to the presence of the recesses 20, there is generated—on the surface 19 of the upper 3—a turbulent limit layer, which guarantees that the fluid vein V is not detached from the surface 19.

This effect is guaranteed at least in the front area of the upper 3, while in the rear area thereof there may easily occur the detachment of the vein, with ensuing increase of the aerodynamic resistance.

The presence of the channels 21*a*,21*b* in the heel 8, as well as the channels 31 in the heelpiece 30, instead allows, as illustrated, channeling the fluid vein V towards the rear part R of the upper 3, without the occurrence of considerable detachment of the vein.

This effect is obtained in the entire area of the rear part R of the upper 3, and in particular also in the area of the heelpiece 30, which is only apparently not hit by the flow of the air during the execution of the pedalling motion.

Thus, the overall result is a considerable reduction of the form drag of the shoe 1, with respect to the cycling shoe of the known type.

The increase of the friction resistance, due to the presence of the recesses 20 in the area of the front part F of the upper 3, is extensively compensated by the aforementioned reduction of the form drag thereof, and thus the overall aerodynamic resistance—which as known is affected by the contribution of both—is considerably reduced.

As easily understandable, the reduction of the aerodynamic resistance of the upper 3 of the shoe 1, in the execution of the pedalling, considerably contributes to limiting the complex turbulent phenomena that occur in the area of the central movement, during the advancement of the human-bicycle system.

Thus, there are increased the aerodynamic performance of the human-bicycle system and for example this is particularly important in professional racing.

In the sole 2 of the shoe 1, at the front portion, there can be provided means 35 for connecting to a quick coupling device of the sole 2 to the bicycle pedal, of the known type.

The connection means 35 may be constituted for example by threaded holes in which there can be engaged respective screws of the quick coupling device.

Figure 8:
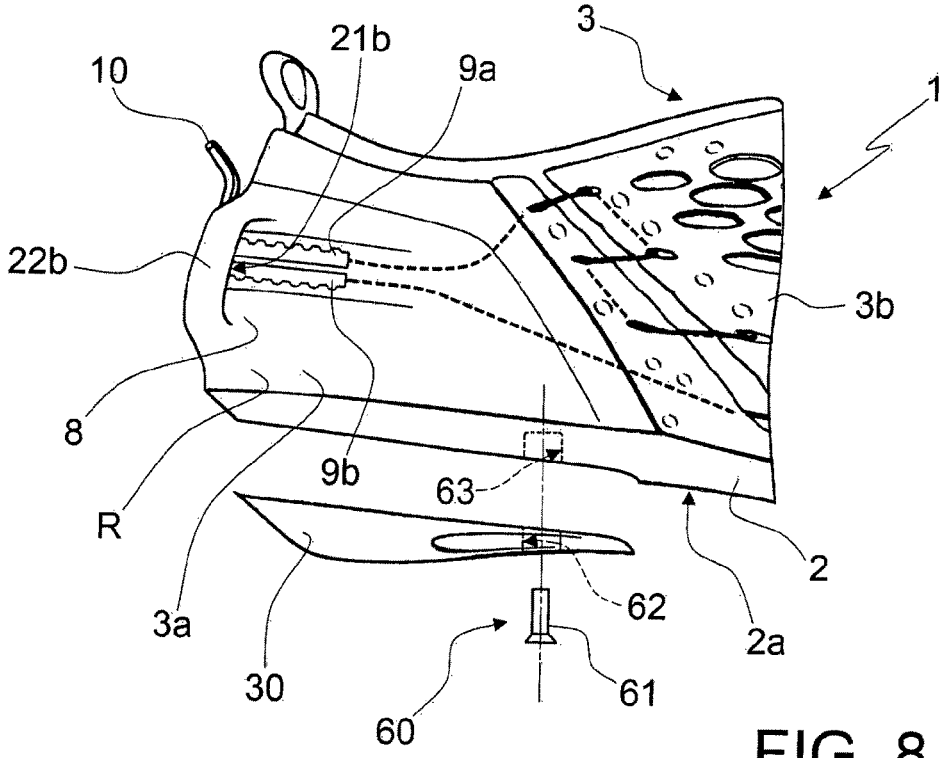
FIG. 8 is a detailed lateral view of another embodiment of the shoe according to the invention.

Another embodiment of the shoe 1 according to the present invention is illustrated in the detail of FIG. 8.

This embodiment of the shoe 1 is identical to that of FIGS. 1-7 as regards most of the characteristics thereof, and the difference solely lies in the fact that the heelpiece 30 is removable from the sole 2.

More in detail, the shoe 1 comprises means 60 for fixing the heelpiece 30 to the sole 2.

The fixing means 60 may for example comprise a screw 61 inserted in a through hole 62 provided in the heelpiece 30, and engaged in a female screw 63 provided for in the rear area of the sole 2.

In other embodiments, the fixing means 60 can for example be of the coupling type, or the like, comprising, for example, at least one appendage provided in the upper surface of the heelpiece 30 which is fittingly engaged in a corresponding seat provided in the rear area of the sole 2, or, vice versa, at least an appendage provided in the rear area of the sole 2 which is fittingly engaged in a respective seat provided in the upper surface of the heelpiece 30.

More in general, the fixing means 60 can be of any type suitable to guarantee the safe connection between the heelpiece 30 and the sole 2, thus avoiding inadvertent detachment.

In order to receive the removable heelpiece 30, the sole 2 comprises a recess 64, provided in the rear area of the lower face 2*a* of the sole.

The fixing means 60 allow the user to easily remove the heelpiece 30 from the sole 2.

For example, it is known that the heelpiece 30 is one of the areas of the shoe 1 that is most subject to wear when walking.

Given that the shoe 1 is mainly conceived for use in the bicycle, the wear of the heelpiece 30 is particularly unwanted—especially in the case of the present invention—in that it can jeopardize the geometric characteristics and thus also the aerodynamic behaviour.

Hence, the user may also need to replace the heelpiece 30 with a new one; or the user may need to replace the heelpiece 30 with another one having different characteristics, for example softer, more rigid, or higher or lower, etc.

The presence of the fixing means 60 particularly quickens and facilitates the operation of removing the heelpiece 30 and replacing it with another one.

Figure 9:
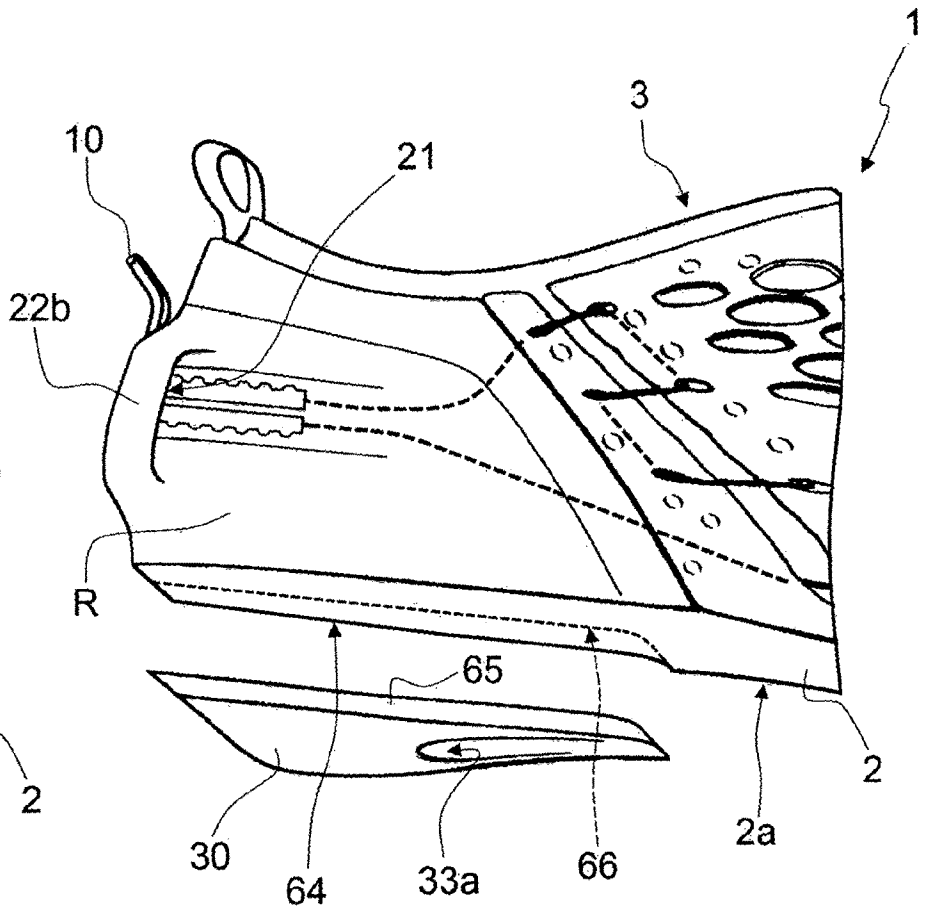
FIG. 9 is a detailed lateral view of the rear part of the shoe in another embodiment of the invention.
Figure 10:
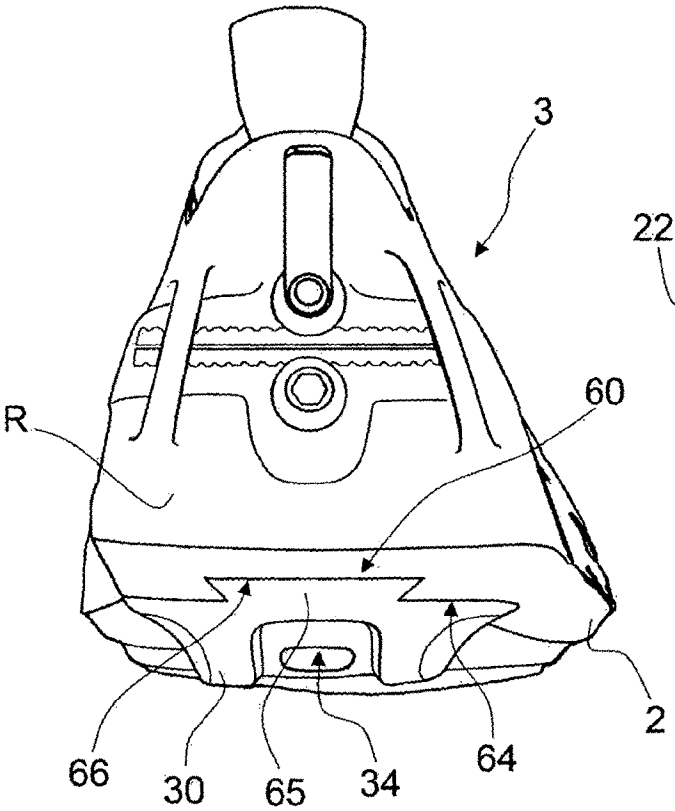
FIG. 10 is a rear view of the shoe according to the embodiment of FIG. 9.

Another embodiment of the shoe according to the present invention is illustrated in FIGS. 9,10.

In this embodiment the shoe 1 is almost entirely identical to that of the preceding embodiment, and the sole difference lies in the means 60 for fixing the heelpiece 30 to the sole 2.

More in detail, in this embodiment the fixing means 60 comprise at least one appendage 65 provided for in the heelpiece 30, suitable for being removably engaged in a corresponding seat 66 provided for in the sole 2, in particular in the recess 64.

The appendage 65 is provided in the upper face of the heelpiece 30.

The appendage 65 and the seat 66 may have a cross-section configured so as to allow the insertion of one into the other from the rear part R of the shoe 1.

For example, in the embodiment represented in FIGS. 9,10, the appendage 65 and the seat 66 have a cross section substantially configured to form a dovetail shape.

The appendage 65 substantially extends over the entire length of the heelpiece 30.

However, in other embodiments, the appendage 65 could only extend for a length portion of the heelpiece 30, or it could be constituted by a plurality of discontinuous sections aligned along the direction of insertion in the seat 66.

The shape of the appendage 65, and correspondingly that of the seat 66, could actually vary, according to the various design and use requirements.

Figure 11:
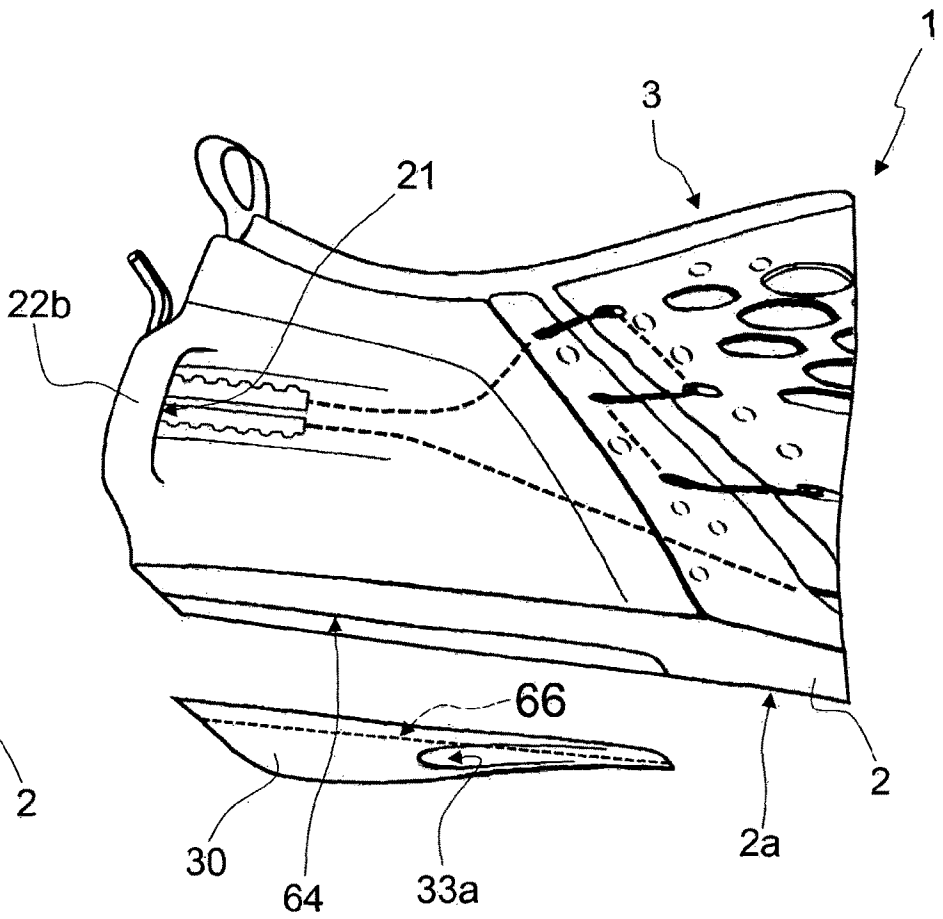
FIG. 11 is a detailed lateral view of the rear part of the shoe in yet another embodiment of the invention.
Figure 12:
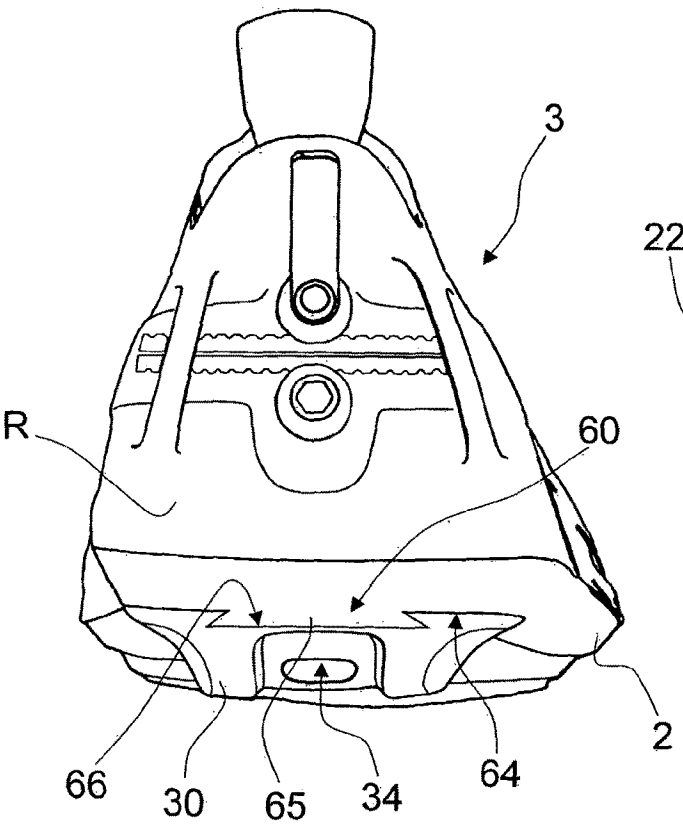
FIG. 12 is a rear view of the shoe according to the embodiment of FIG. 11.

Another embodiment of the shoe 1 according to the invention is illustrated in FIGS. 11,12.

In this embodiment, the shoe 1 is different from that of the embodiment of FIGS. 9,10 for forming the means 60 for fixing the heelpiece 30 to the sole 2.

More in detail, the fixing means 60 comprise at least one appendage 65 provided in the sole 2, in particular at the recess 64, suitable to be removably engaged in a corresponding seat 66 provided for in the heelpiece 30.

In particular, the seat 66 is provided in the upper face of the heelpiece 30.

The appendage 65 and the seat 66 may have a cross section shaped so as to allow the insertion of one into the other from the rear part R of the shoe 1.

For example, even in the embodiment represented in FIGS. 11,12, the appendage 65 and the seat 66 have a cross section substantially configured to form a dovetail shape.

The appendage 65 substantially extends over the entire length of the rear area of the lower face 2*a* of the sole 2.

In other embodiments, the appendage 65 could be constituted by a plurality of discontinuous sections aligned along the direction of insertion in the seat 66.

Also in this case, the shape of the appendage 65, and correspondingly that of the seat 66, could actually be variously shaped, depending on the different design and use requirements.

In the embodiments of FIGS. 9-12, the removal of the heelpiece 30 from the sole 2, for maintenance and/or replacement operations, may also be carried out without using tools, given that between the two parts, as observable, there is present a simple shape coupling.

FIGS. 13-17 show some representative photographs of the results achieved by the aerodynamic simulation, made at computer using specific software tools, of some cycling shoes of the known kind.

Figure 18:
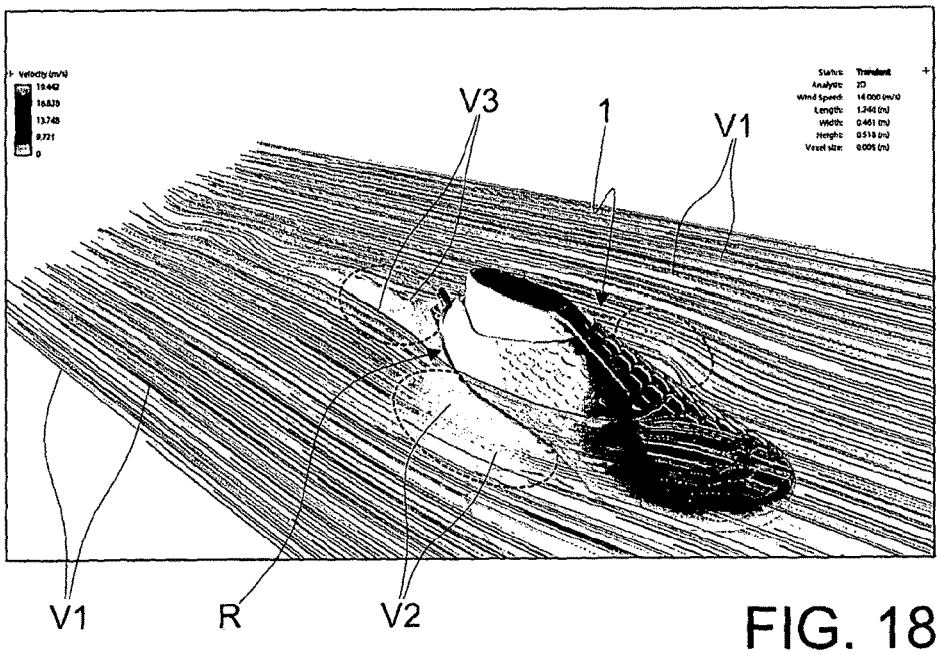
FIG. 18 is a representative photograph of the result achieved by a computer implemented aerodynamic simulation of the cycling shoe according to the present invention.
Figure 19:
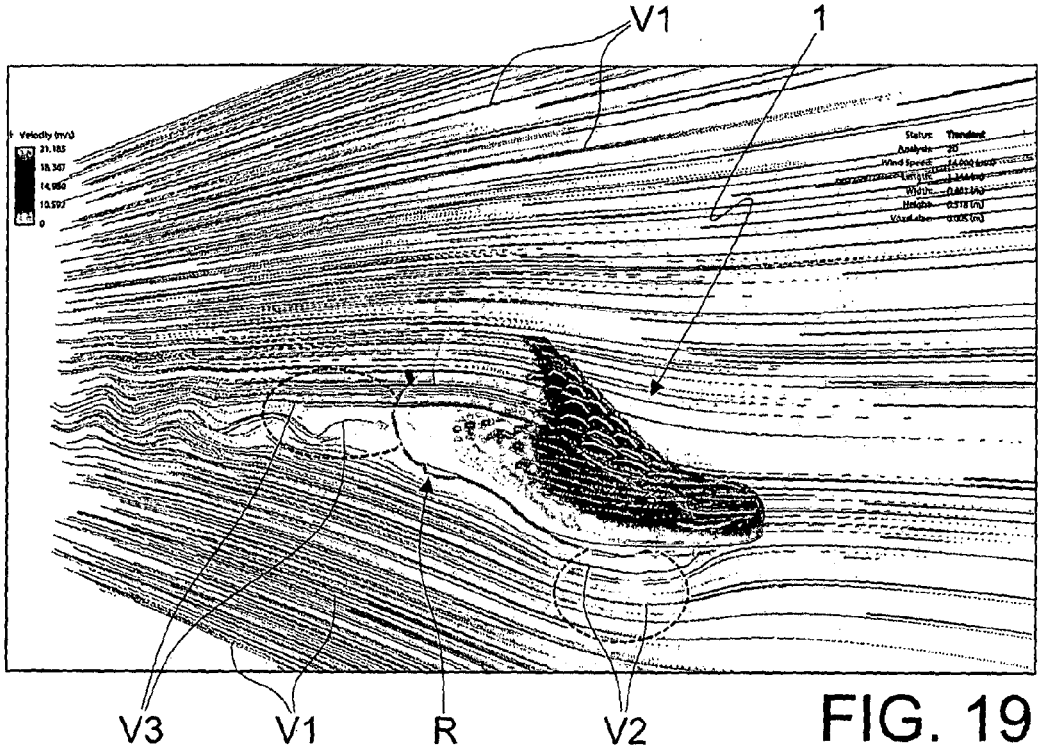
FIG. 19 is another photograph, from different angle, of the aerodynamic simulation relative to the cycling shoe according to the present invention.

FIGS. 18 and 19 show, on the other hand, some representative photographs of the results achieved by the aerodynamic simulation of the same kind having for object the shoe 1 according to the present invention.

In particular, the results achieved by the aerodynamic simulations are analysed hereinafter with reference to the air speed in the areas surrounding the shoes, and to the route of the fluid vein V around them.

Figure 13:
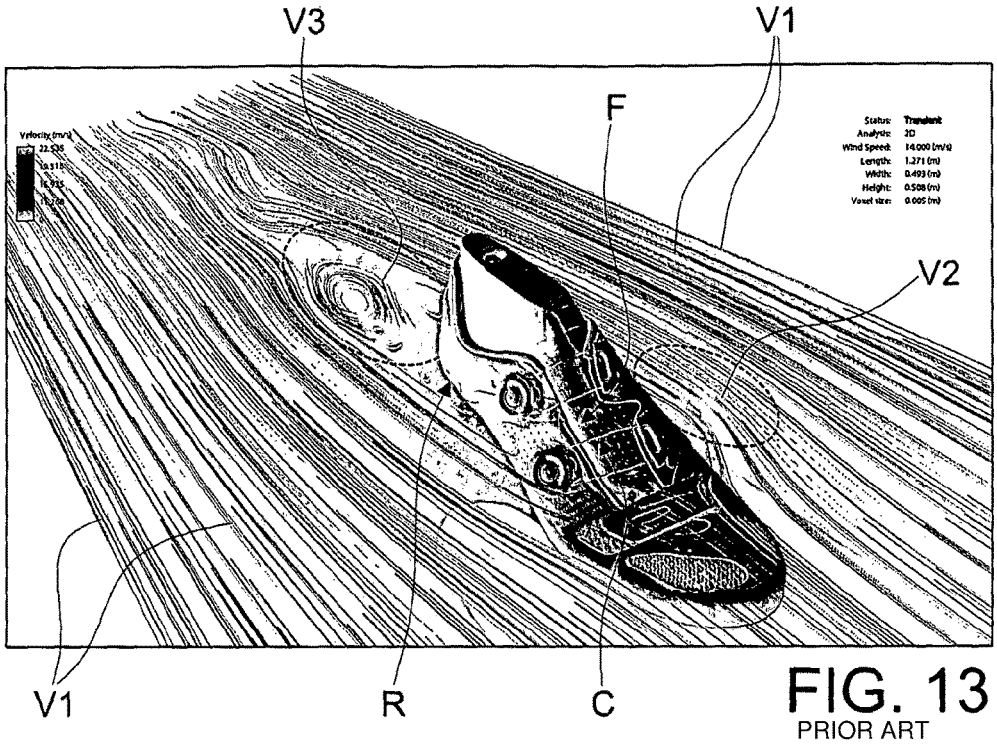
FIG. 13 PRIOR ART
FIG. 13 is a representative photograph of the result achieved by a computer implemented aerodynamic simulation of a cycling shoe of the known kind.
Figure 14:
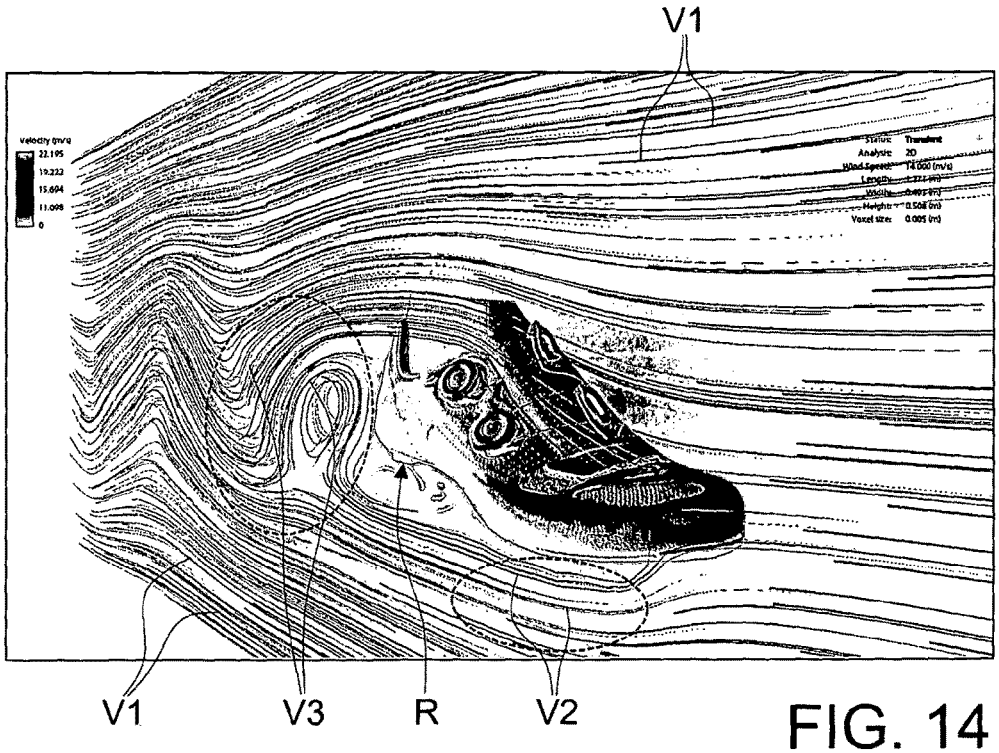
FIG. 14 PRIOR ART
FIG. 14 is another photograph, from different angle, of the aerodynamic simulation relative to the same shoe of FIG. 13.

For instance FIGS. 13,14 show the aerodynamic simulation of a cycling shoe of the known kind having closure means C of the upper foreseen on the front part F.

In particular FIGS. 13,14 refer to the same shoe observed from different angles. Taking as a reference value the speed value V1 of fluid veins which do not lap the shoe, that is the wind speed selected for the simulation, it is observed that the fluid veins which, instead, directly lap the shoe assume a speed value V2 greater than V1 mainly around the flanks of the shoe, and marginally also by the sole of the shoe; the same fluid veins considerably slow down when they reach the rear part R of the shoe itself, till they assume zero speed V3, or substantially zero speed, with formation of considerable turbulence, the latter being a phenomenon which, as said, is particularly unwelcome.

Figure 15:
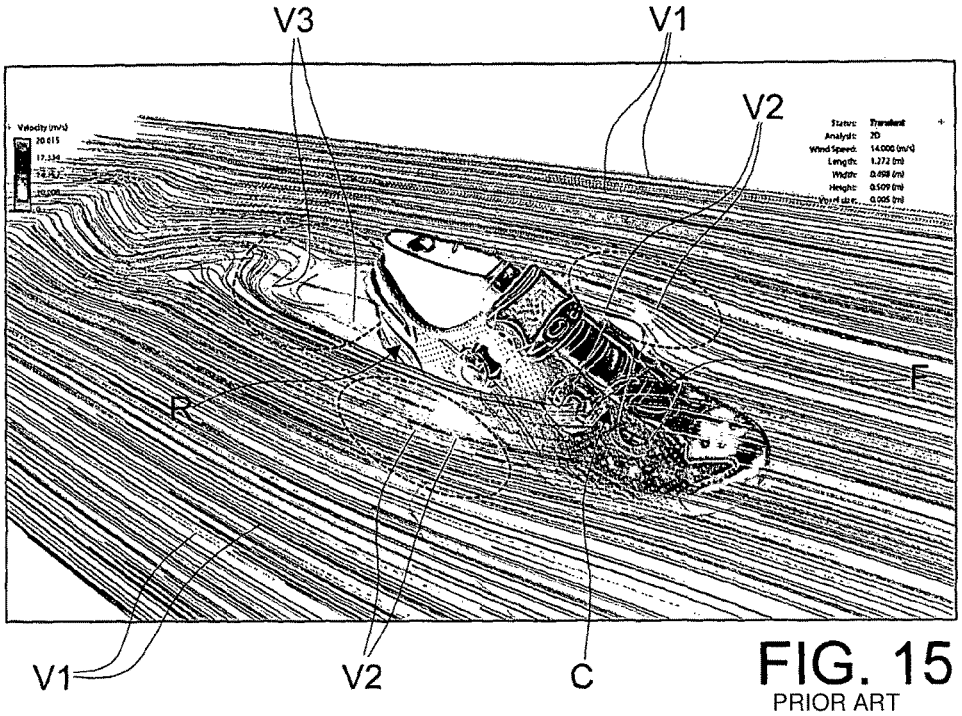
FIG. 15 PRIOR ART
FIG. 15 is a representative photograph of the result achieved by a computer implemented aerodynamic simulation of another cycling shoe of the known kind.

FIG. 15 refers to the results of the aerodynamic simulation having for object another cycling shoe of the known kind.

Also in this case the shoe has closure means C of the upper foreseen on the front part F.

As it can be observed, the results of this simulation are very similar to those regarding the shoe of FIGS. 13,14, also in this case with formation of considerable turbulence phenomena by the rear part R of the shoe.

Figure 16:
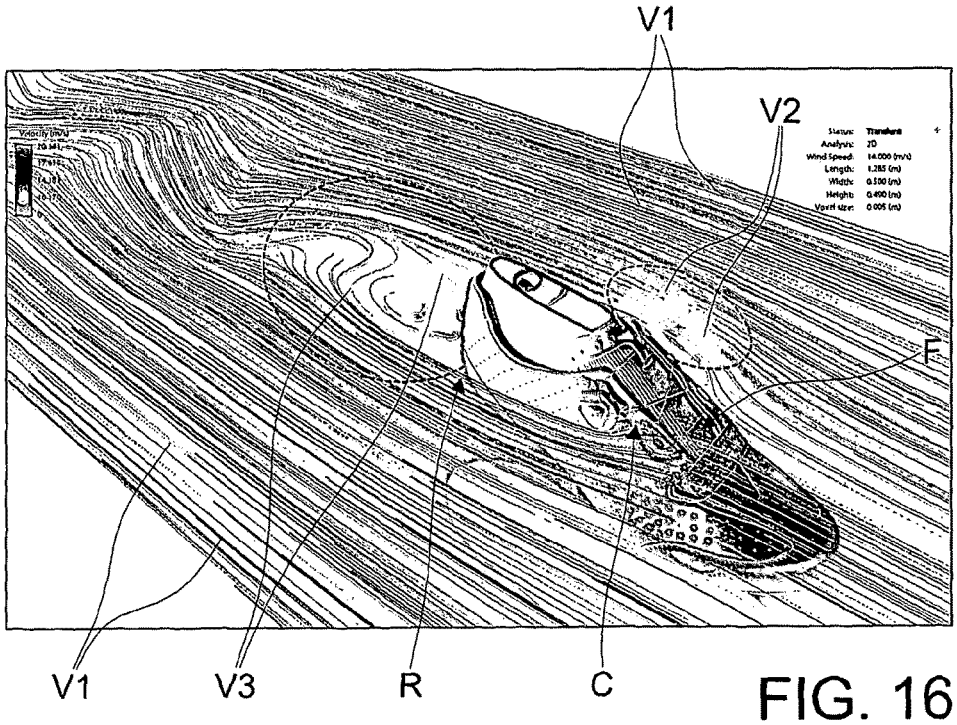
FIG. 16 PRIOR ART
FIG. 16 is a representative photograph of the result achieved by a computer implemented aerodynamic simulation of still another cycling shoe of the known kind.
Figure 17:
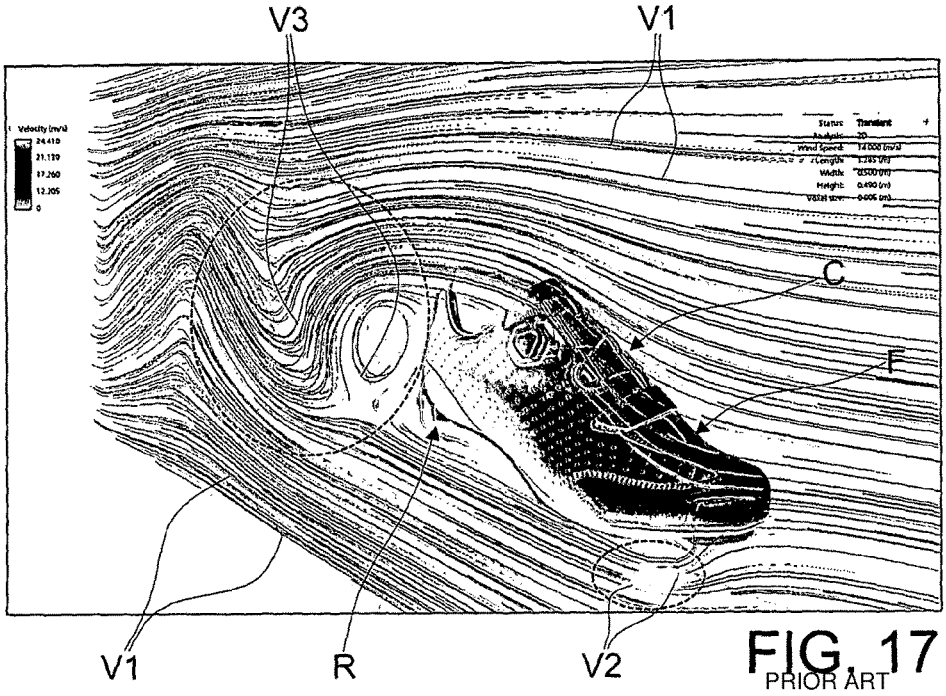
FIG. 17 PRIOR ART
FIG. 17 is another photograph, from different angle, of the aerodynamic simulation relative to the same shoe of FIG. 16.

FIGS. 16 and 17 show the aerodynamic simulation having for object still another cycling shoe of the known kind, again comprising closure means C of the upper foreseen on the front part F.

Again the simulation result shows evident and undesirable turbulence phenomena by the rear part R of the shoe, with speed V3 of the fluid veins which is zero or close to zero.

FIGS. 18 and 19 refers, on the other hand, to the results of the aerodynamic simulation performed on the shoe 1 according to the present invention.

As it can be observed, the results of the aerodynamic simulation are markedly different from those achieved on the shoes of the known kind (FIGS. 13-17).

In fact, the acceleration of the fluid vein (with speed V2) is achieved on areas around the shoe 1 which are much wider, in particular along the flanks of the shoe itself.

This first result is certainly very interesting, because it means an optimal air penetration of the shoe 1.

Furthermore, even more evident is the reduction of turbulence phenomena by the rear part R of the shoe 1; in other words, the reduction of the fluid vein speed to values V3 which are zero or close to zero by the rear part R is definitely more confined.

This shows very clearly that the aerodynamic behaviour of the shoe 1 according to the invention is greatly improved and refined compared to the shoes of the known kind. It has thus been observed that the invention attains the set objects.

The invention may be subjected to other modifications and variants falling within the scope of protection defined by the claims.

The invention claimed is:

1. A cycling shoe, comprising a sole provided with an upper face and a lower face, as well as an upper that rises up from said sole, wherein the surface of said upper comprises a plurality of recesses suitable for decreasing the form drag of said upper hit by air, wherein said sole comprises a heelpiece comprising a channeling, for conveying the air that hits the shoe through a predetermined path, in order to reduce the form drag, wherein said channeling comprises a first branch and a second branch which are not open at the upper face of the sole and which are open, respectively, at a first air inlet opening and at a second air inlet opening provided for in the lower face of the sole and on the opposite sides of the heelpiece, and wherein the first branch and the second branch communicate with a single rear discharge of the heelpiece, and wherein the heelpiece does not project with respect to the lower face of the sole, so as to define a continuous surface alongside the lower face of the sole.

2. The shoe according to claim 1, wherein at least some of said recesses consist of through openings going through said upper.

3. The shoe according to claim 1, wherein said upper comprises a heel provided with at least one channel, achieved in its thickness and suitable for channeling the air that hits said upper during pedaling, to further reduce the form drag thereof.

4. The shoe according to claim 3, wherein said at least one channel comprises a first channel and a second channel, achieved in the thickness of said heel and suitable for channeling the air that hits said upper, said first channel and second channel being arranged on the outer side and on the inner side, respectively, of said heel.

5. The shoe according to claim 4, wherein said first channel and second channel are defined by respective bridges shaped by said heel, arranged substantially vertically with respect to the support plane of said sole.

6. The shoe according to claim 1, wherein said heelpiece is removably engaged at a recess provided in the rear area of the lower face of said sole.

7. The shoe according to claim 1, comprising a fixing means for fixing said heelpiece to said sole.

8. The shoe according to claim 7, wherein said fixing means comprise at least one screw inserted in a through hole provided in said heelpiece, and engaged in a mother screw provided in the rear area of the lower face of said sole.

9. The shoe according to claim 7, wherein said fixing means comprise at least one appendage provided in said heelpiece, suitable for engaging in a removable manner in a corresponding seat provided in said sole.

10. The shoe according to claim 7, wherein said fixing means comprise at least one appendage provided in said sole, suitable for engaging in a removable manner in a corresponding seat provided in said heelpiece.

11. The shoe according to claim 1, wherein some of said recesses are distributed in a front area of said upper.

12. The shoe according to claim 11, wherein said recesses distributed in the front area of said upper have greater dimension than those distributed in other areas of said upper.

13. The shoe according to claim 11, wherein said recesses have oval or substantially polygonal shape, substantially stretched along the longitudinal axis of the shoe.

14. The shoe according to claim 1, wherein the first branch and the second branch have convergent sections from the respective first, second opening towards the rear discharge.

15. A cycling shoe, comprising a sole defining a support plane, as well as an upper that rises up from said sole, wherein the surface of said upper comprises a plurality of recesses suitable for decreasing the form drag of said upper hit by air, wherein said upper comprises a heel provided with a first channel and a second channel, achieved in the thickness of said heel and suitable for channeling the air that hits said upper, said first channel and second channel being arranged on the outer side and on the inner side, respectively, of said heel, and wherein said first channel and second channel are defined by respective bridges shaped by said heel, arranged substantially vertically with respect to the support plane of said sole, wherein the cross-section of the first channel and of the second channel is vertically elongated with respect to the support plane of the sole, so that the first channel and the second channel allows channeling the fluid vein of the air that hits the front part of the upper towards the rear part of the upper.

* * * * *